United States Patent [19]

Hida et al.

[11] Patent Number: 4,986,081

[45] Date of Patent: Jan. 22, 1991

[54] ELECTRIC CONTROL APPARATUS FOR AUGER TYPE ICE MAKING MACHINE

[75] Inventors: Junichi Hida; Naoya Uchida; Susumu Tatematsu, all of Nagoya, Japan

[73] Assignee: Hoshizaki Denki Kabushiki Kaisha, Toyoake, Japan

[21] Appl. No.: 506,040

[22] Filed: Apr. 9, 1990

[30] Foreign Application Priority Data

Apr. 7, 1989 [JP] Japan ..... 1-86727

[51] Int. Cl.[5] ..... F25C 1/00

[52] U.S. Cl. ..... 62/130; 62/188; 62/233; 62/135

[58] Field of Search ..... 62/129, 126, 130, 135, 62/136, 137, 138, 139, 125, 233, 340, 342, 343, 353, 354, 157, 158, 188, 189

[56] References Cited

U.S. PATENT DOCUMENTS

| | | | |
|---|---|---|---|
| 4,622,826 | 11/1986 | Tsukiyama et al. | 62/137 |
| 4,644,757 | 2/1987 | Hida et al. | 62/188 |
| 4,741,173 | 5/1988 | Neumann | 62/298 |
| 4,850,202 | 7/1989 | Kito et al. | 62/354 X |

FOREIGN PATENT DOCUMENTS

| | | |
|---|---|---|
| 57-41669 | 9/1982 | Japan . |
| 60-17655 | 5/1985 | Japan . |
| 61-28999 | 8/1986 | Japan . |

*Primary Examiner*—Harry B. Tanner

*Attorney, Agent, or Firm*—Armstrong, Nikaido, Marmelstein, Kubovcik, & Murray

[57] ABSTRACT

An electric control apparatus for an auger type ice making machine having an auger mounted for rotary movement within an evaporator housing to which water is supplied from a water tank to cause ice crystals to form on the internal freezing surface of the evaporator housing. The control apparatus includes a first water level detector disposed within the water tank to produce a first signal therefrom when a level of water in the tank has fallen to a lower limit level, a second level detector disposed within the water tank to produce a second signal therefrom the level of water has risen to an upper limit level, a timer cooperable with the second water level detector for measuring a predetermined period of time in response to the second signal, the period f time being determined to correspond with a time interval defined by the first and second signals in normal operation of the ice making machine, and a relay circuit cooperable with the first water level detector and the timer for rendering the ice making machine inoperative when the predetermined period of time has been measured by the timer before applied with the first signal.

4 Claims, 3 Drawing Sheets

ELECTRIC CONTROL APPARATUS FOR AUGER TYPE ICE MAKING MACHINE

BACKGROUND OF THE INVENTION

1. Field of the Invention

The present invention relates to an electric control apparatus for auger type ice making machines, and more particularly to an electric control apparatus for protecting the ice making machine from an excessive load applied thereto in operation.

2. Discussion of the Prior Art

As schematically illustrated in FIG. 3, a conventional auger type ice making machine incorporates an auger which is mounted for rotary movement within the cylindrical housing 4 of an evaporator 41 to which water is supplied to cause ice crystals to form on the internal freezing surface of the evaporator housing. As the auger is driven by an electric motor 2, the helical blade thereof scrapes the ice crystals off the internal freezing surface of the evaporator housing 4 and advances the scraped ice crystals upwardly toward an extruding head 6. The ice compressed at the extruding head 6 is broken by a breaker blade and delivered as pieces of hard ice to an ice storage bin 8. The storage bin 8 has an opening arranged to permit the pieces of hard ice to move outwardly along an appropriate chute. If in operation the delivery chute is blocked up due to the pieces of hard ice accumulated thereon, the storage bin 8 will be fully filled with the pieces of hard ice delivered from the extruding head 6. As a result, the pieces of hard ice are frozen in the storage bin 8 to cause an excessive load acting on the auger. To eliminate such an excessive load acting on the auger, a pressure gauge 42 is provided to detect a pressure drop of refrigerant in the refrigeration circuit, and a hot gas valve 43 is disposed in a bypass line of the refrigeration circuit to be opened for dissolution of the frozen ice when the pressure drop of refrigerant has been detected by the pressure guage 42.

In Japanese Utility Model Publication No. 61-28999, there has been proposed an electric control apparatus for the auger type- ice making machine which includes a movable plate arranged to be pushed up by the pieces of hard ice packed in the storage bin and a normally open detection switch associated with the movable plate to deactivate the electric motor for the ice making machine when it has been closed by upward movement of the movable-plate. In operation of the ice making machine, the ice crystals in the evaporator housing are frozen during a shortage or during suspension of the water supply to the auger. Such an abnormal freezing phenomenon of ice crystals may not be avoided by the control apparatus described above. To avoid the abnormal freezing phenomenon caused by the shortage of the water supply, Japanese Patent Publication No. 57-41669 discloses an electric control apparatus for an auger type ice making machine which includes a water level detector arranged to detect the level of water in the evaporator housing thereby to deactivate the electric motor for the ice making machine when an abnormal fall of the water level is detected. To avoid the abnormal freezing phenomenon caused by suspension of the water supply, Japanese Utility Model Publication No. 60-17655 discloses an electric control apparatus for an auger type ice making machine which includes a float switch disposed in a water tank in communication with the evaporator housing to detect the level of water in the water tank thereby to deactivate the electric motor and compressor for the ice making machine when an abnormal fall of the water level is detected.

Under control of the hot gas valve described above, the pressure drop of the refrigerant in the refrigeration circuit is detected after the ice crystals in the evaporator housing have been frozen. It is, therefore, impossible to avoid the occurrence of an excessive load acting on the auger and the abnormal freezing phenomenon caused by a shortage of the water supply. When a constant pressure expansion valve is adapted to maintain the pressure of the refrigerant in the refrigeration circuit at a predetermined level, the control of the hot gas valve may not be adapted. It is further apparent that the detection switch associated with the movable plate is useless to avoid the abnormal freezing phenomenon in the evaporator housing caused by suspension of water supply, whereas the water level detector is useless to eliminate an excessive load caused by the pieces of hard ice packed in the storage bin.

SUMMARY

It is, therefore, a primary object of the present invention to provide an electric control apparatus for the auger type ice making machine capable of protecting the auger from an excessive load caused by the pieces of hard ice packed in the storage bin and capable of avoiding an abnormal freezing of ice crystals in the evaporator housing caused by a shortage or suspension of the water supply.

According to the present invention, the primary object is attained by providing an electric control apparatus for an auger type ice making machine having an auger mounted for rotary movement within a evaporator housing to which water is supplied from a water tank to cause ice crystals to form on the internal freezing surface of the evaporator housing. The apparatus comprises a first water level detector disposed within the water tank to detect a level of water in the water tank for producing a first signal therefrom when the level of water has fallen to a lower limit level. A second water level detector is disposed within the water tank to detect the level of water in the water tank for producing a second signal therefrom when the level of water has risen up to an upper limit level. A timer is cooperable with the second water level detector for measuring a predetermined period of time in response to the second signal. The period of time is determined to correspond with a time interval defined by the first and second signals which represent a normal operation of the ice making. A device is cooperable with the first water level detector and the timer for rendering the ice making machine inoperative when the predetermined period of time has been measured by the timer before the first signal is applied.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
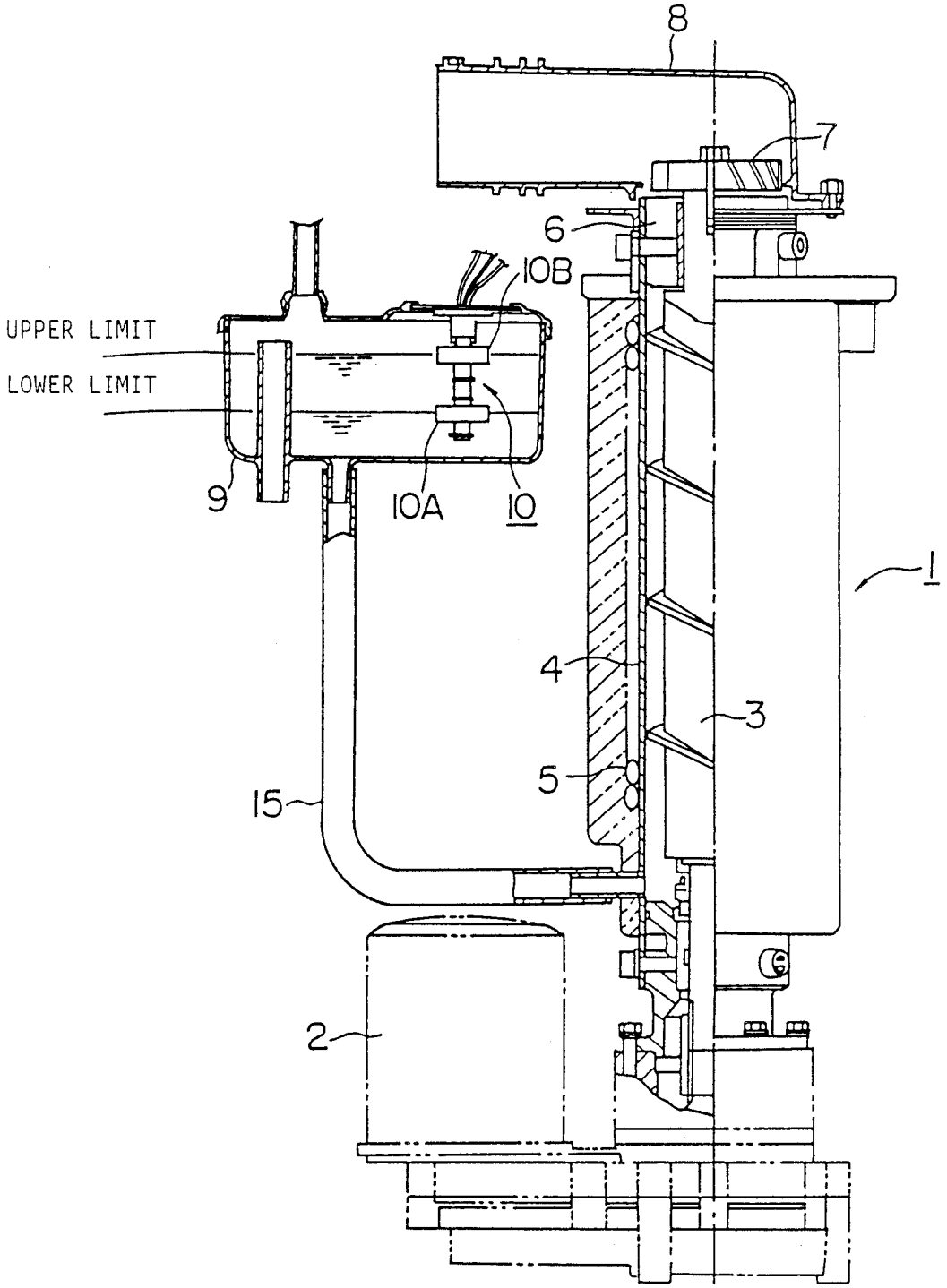
FIG. 1 is a partly broken sectional view of an auger type ice making machine.
Figure 3:
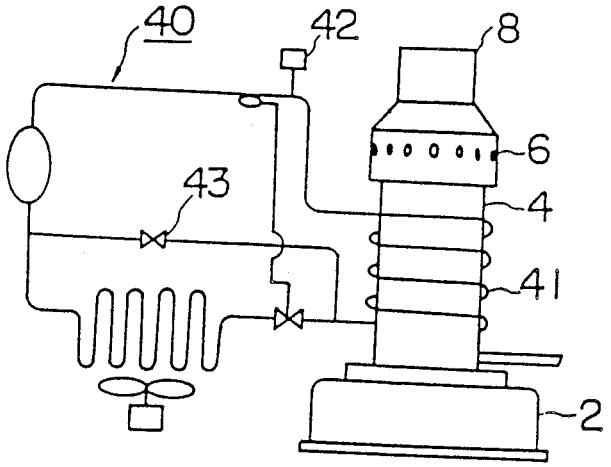
FIG. 3 is a schematic illustration of a conventional auger type ice making machine for discussion of the prior art.

Referring now to the drawings, FIG. 1 illustrates an auger type ice making machine which includes an evaporator housing 4 surrounded by a coil 5 through which refrigerant is passed in a usual manner to chill the housing 4. The evaporator coil 5 is provided as a part of a refrigeration circuit such as shown in FIG. 3 and is surrounded by an insulation material. An auger 3 is mounted for rotary movement within the evaporator housing 4 to which water is supplied to cause ice crystals to form on the internal freezing surface of the evaporator housing 4. The auger 3 has a lower shaft portion which is drivingly connected to an electric geared motor 2 to rotate the auger 3. In operation, the helical blade of auger 3 scrapes the ice crystals off the internal freezing surface of evaporator housing 4 and advances the scraped ice crystals upwardly toward an extruding head 6 which forms a plenum at the top of auger 3. A breaker in the form of a cutter 7 is mounted on the auger 3 for rotation therewith, and a discharge duct 8 is mounted on the upper end of evaporator housing 4 to discharge pieces of hard ice broken by the breaker 7 therefrom into an ice storage bin (not show).

Figure 2:
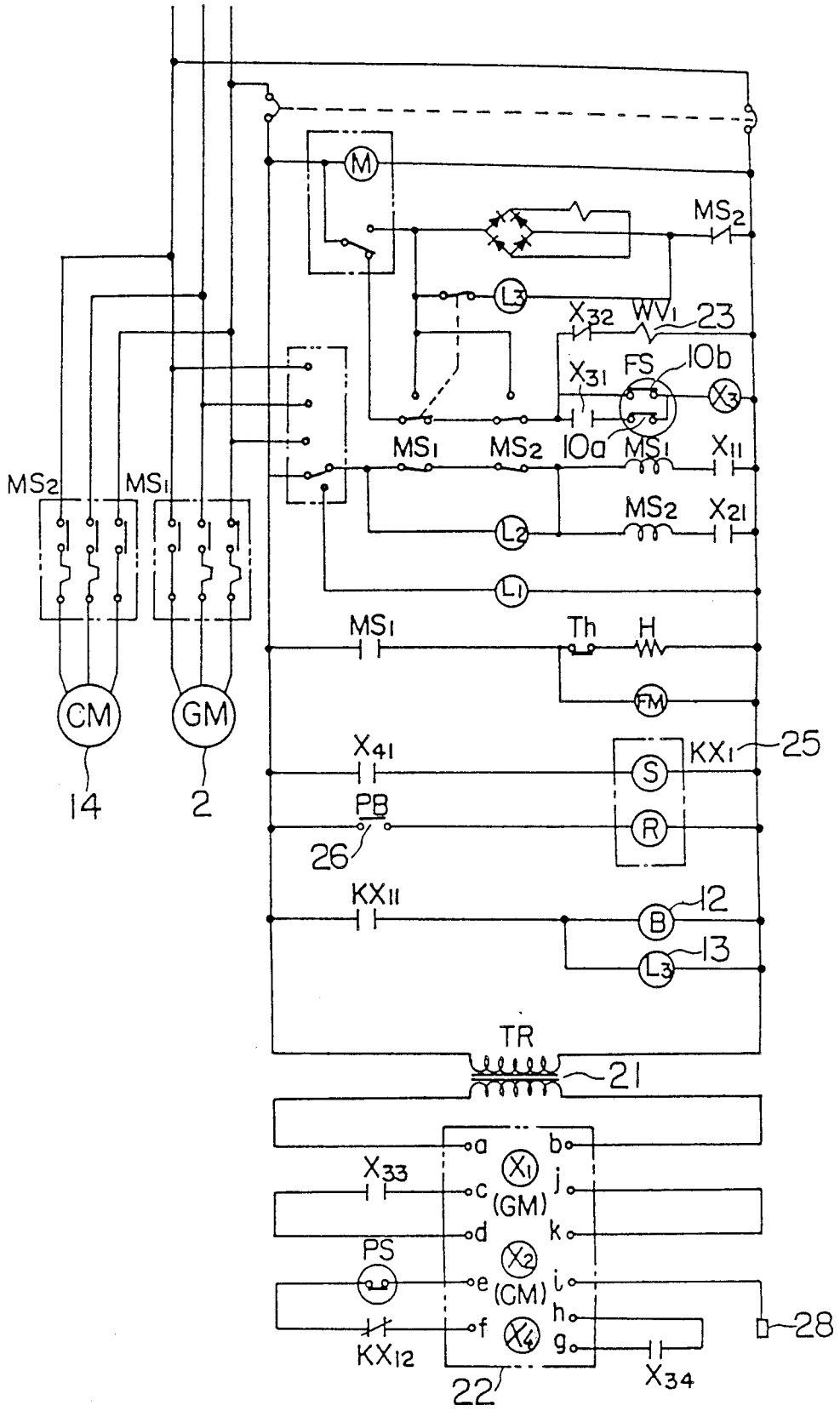
FIG. 2 is a circuit diagram of an electric control apparatus for the auger type ice making machine shown in FIG. 1.

A water tank 9 is arranged adjacent the upper portion of evaporator housing 4 to be supplied with fresh water from any suitable source of water (not shown) through a solenoid water valve 23 shown in FIG. 2. A water supply pipe 15 leading from the water tank 9 is connected to the bottom portion of evaporator housing 4 to supply fresh water to the internal freezing surface of evaporator housing 4. The water tank 9 is provided therein with a float switch assembly 10 which includes lower and upper float switches 10A and 10B of the normally open type respectively for detecting lower and upper limit levels of water in the tank 9. When the water in evaporator housing 4 is formed into ice crystals during operation of the ice making machine, fresh water from the tank 9 is continuously supplied to the internal freezing surface of evaporator housing 4 to cause a fall of the water level in tank 9. When the level of water in tank 9 falls to the lower limit level, the lower float switch 10A is opened to energize the solenoid water valve 23 under the control of an electric control apparatus for an ice making machine shown in FIG. 2 to permit the fresh water to be supplied into the tank 9 from the source of water. When the level of water in tank 9 rises up to the upper limit level, the upper float switch 10B is closed to deenergize the solenoid water valve 23 under the control of the electric control apparatus.

As shown in FIG. 2, the electric control apparatus includes a relay $X_3$ cooperable with normally open relay switches $X_{31}$, $X_{33}$, $X_{34}$ and a normally closed relay switch $X_{32}$ which is connected in series with the solenoid water valve 23. The lower float switch 10A is in the form of a normally open switch 10*a* connected in series at its one end with the relay $X_3$ and at its other end with the normally open relay switch $X_{31}$, while the upper float switch 10B is in the form of a normally open switch 10*b* connected in series at its one end with the relay $X_3$ and at its other end with a power source line. When the power source line is connected to an electric power source through a main switch (not shown), the solenoid water valve 23 is energized by the electric power applied thereto through the normally closed relay switch $X_{32}$ to permit the fresh water to be supplied into the water tank 9 therethrough from the source of water, and in turn, the fresh water from tank 9 is supplied into the bottom portion of evaporator housing 4 through the water supply pipe 15. When the amount of fresh water in tank 9 increases up to the upper limit level, the upper float switch 10*b* is closed to energize the relay $X_3$. In response to energization of the relay $X_3$, the normally closed relay switch $X_{32}$ is opened, while the normally open relay switches $X_{31}$, $X_{33}$ and $X_{34}$ are closed. As a result, the solenoid water valve 23 is deenergized to interrupt the supply of fresh water into the water tank 9, and the relay $X_3$ is maintained in its energized condition until the lower float switch 10*a* is opened.

The electric control apparatus includes a timer board 22 which is provided therein with a first relay $X_1$ cooperable with a normally open relay switch $X_{11}$, a second relay $X_2$ cooperable with a normally open relay switch $X_{21}$ and a third relay $X_4$ cooperable with a normally open relay switch $X_{41}$. The first relay $X_1$ is connected at its one end to a terminal c and at its other end to a terminal d to be energized when the normally open relay switch $X_{33}$ has been closed by energization of the relay $X_1$. When the normally open relay switch $X_{11}$ is closed by energization of the relay $X_1$, a relay coil $MS_1$ is energized to close the associated normally open relay switches $MS_1$. Thus, the geared motor 2 is activated by the electric power supplied thereto through the relay switches $MS_1$ to rotate the auger 3. The timer board 22 includes a first timer A which is arranged to energize the relay $X_2$ after a lapse of a first predetermined period of time $t_1$ when the geared motor 2 has been activated. When the relay $X_2$ is energized under control of the first timer A, the normally open relay switch $X_{21}$ is closed to energize a relay coil $MS_2$. Thus, normally open relay switches $MS_2$ associated with the relay coil $MS_2$ are closed to activate a compressor 14 of the ice making machine thereby to compress gaseous refrigerant in the refrigeration circuit.

The timer board 22 further includes a second timer B arranged to measure a second predetermined period of time $t_2$ under control of the first timer A and a third timer C arranged to measure a third predetermined period of time $t_3$ under control of the second timer B. The second predetermined period of time $t_2$ is defined taking into consideration a time for which operation of the ice making machine is made in a stable condition to advance the ice crystals upwardly through the extruding head 6. The third predetermined period of time $t_3$ is defined on a basis of the following fact. Assuming that the ice making capacity of the machine is determined in a normal condition, the float switches 10*a* and 10*b* are repeatedly turned on and off at a predetermined time interval during normal operation of the ice making machine. This means that the time interval is defined in proportion to the amount of ice crystals formed in the evaporator housing 4 during normal operation of the ice making machine. In other words, the drop speed of the water level in tank 9 is determined in dependence upon the amount of ice crystals formed in the evaporator housing 4. For this reason, the third predetermined period of time $t_3$ is defined to correspond with the time interval described above.

If the ice making machine is operated in a condition where the relay switch $X_{34}$ is maintained in its closed portion for a period of time longer than the third predetermined period of time $t_3$, the amount of ice crystals formed in the evaporator housing 4 will decrease due to abnormal freezing thereof. Thus, measurement of the third predetermined period of time $t_3$ is useful to detect the abnormal freezing of ice crystals in the evaporator housing 4. In the timer board 22, the third timer C acts to initiate the measurement of the third predetermined period of time $t_3$ after a lapse of the second predetermined period of time $t_2$ measured by the second timer B thereby to determine the actual time interval in comparison with the third predetermined period of time $t_3$.

Figure 4:
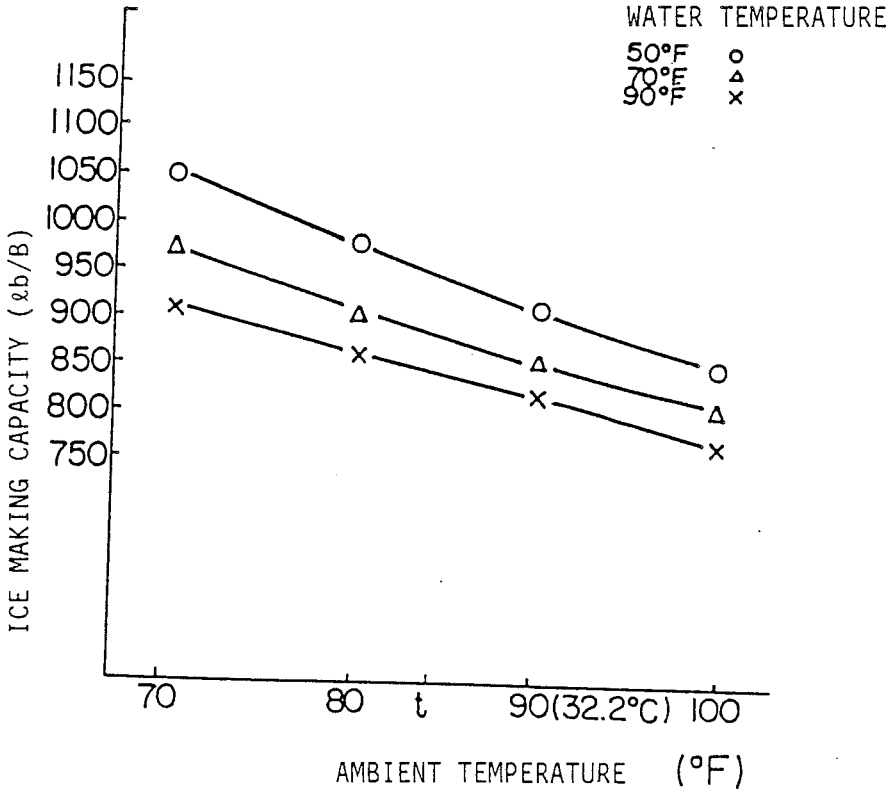
FIG. 4 is a graph showing a relationship between an ambient temperature and an ice making capacity of the icemaker.

A thermister 28 is connected to a terminal i of timer board 22 to detect an ambient temperature of the ice making machine. In a practical embodiment of the present invention, it is desirable that the third predetermined period of time $t_3$ is compensated in accordance with a change of the ambient temperature detected by thermistor 28. As shown in FIG. 4, the ice making capacity will change in accordance with ambient temperature of the ice making machine and temperature of water supplied into the evaporator housing 4 from the water tank 9. It is, therefore, desirable that the third predetermined period of time t3 is further compensated in accordance with a change in the water temperature.

Assuming that in operation of the ice making machine the third predetermined period of time $t_3$ has been measured by the third timer C in a condition where the lower float switch 10*a* is still maintained in its closed position, the relay $X_4$ is energized under control of the third timer C to close the relay switch $X_{41}$, and in turn, a keep-relay 25 ($KX_1$) is energized to close a normally open relay switch $KX_{11}$ and to open a normally closed relay switch $KX_{12}$. As a result, the relays $X_1$ and $X_2$ are deenergized under control of the relay switch $KX_{12}$ to deactivate the geared motor 2 and compressor 14, and a buzzer 12 and an alarm lamp 13 are energized under control of the relay switch $KX_{11}$. Thus, the ice making machine is protected from an excessive load acting on the auger 3, and the operator is informed of an abnormal condition of the ice making machine. When the abnormal condition of the ice making machine has been eliminated, a push-button switch 26 is closed to reset the keep-relay 25 ($KX_1$) thereby to return the relay switches $KX_{11}$ and $KX_{12}$ to their original positions.

Having now fully set forth a preferred embodiment of the concept underlying the present invention, various other embodiments as well as certain variations and modifications of the embodiment shown and described herein will obviously occur to those skilled in the art upon becoming familiar with the underlying concept. It is to be understood, therefore, that within the scope of the appended claims, the invention may be practiced otherwise than as specifically set forth herein.

What is claimed is:

1. An electric control apparatus for an auger type ice making machine having an auger mounted for rotary movement within an evaporator housing to which water is supplied from a water tank to cause ice crystals to form on an internal freezing surface of said evaporator housing, the electric control apparatus comprising:

a first water level detector disposed within said water tank to detect a level of water in said water tank for producing a first signal therefrom when the level of water has fallen to a lower limit level;

a second water level detector disposed within said water tank to detect the level of water in said water tank for producing a second signal therefrom when the level of water has risen up to an upper limit level;

a timer cooperable with said second water level detector for measuring a predetermined period of time in response to said second signal, the period of time being determined to correspond with a time interval defined by said first and second signals during normal operation of the ice making machine; and means cooperable with said first water level detector and said timer for rendering the ice making machine inoperative when the predetermined period of time has been measured by said timer before said first signal is applied thereto.

2. An electric control apparatus as claimed in claim 1, further comprising a temperature sensor for detecting an ambient temperature of the ice making machine, wherein said timer is cooperable with said temperature sensor to compensate the predetermined period of time in accordance with the ambient temperature of the ice making machine.

3. An electric control apparatus as claimed in claim 1, wherein said first water level detector is a lower float switch of a normally open type disposed within said water tank to be opened when the level of water has fallen to the lower limit level, and said second water level detector is an upper float switch of a normally open type disposed within said water tank to be closed when the level of water has risen to the upper limit level.

4. An electric control apparatus as claimed in claim 3, wherein said means cooperable with said first water level detector and said timer includes a relay circuit arranged to interrupt a power supply to a refrigerant compressor and an electric motor for said auger in the ice making machine when the predetermined period of time has been measured by said timer before said first signal from said first water level detector is applied thereto.

* * * * *